United States Patent [19]

Chu et al.

[11] Patent Number: 4,522,382

[45] Date of Patent: Jun. 11, 1985

[54] SHEET AND ENVELOPE FEED APPARATUS FOR A PRINTER AND ASSOCIATED METHODS

[75] Inventors: Mosi Chu, Setauket; Meng S. Kuo, Ponkonkoma, both of N.Y.

[73] Assignee: Primages, Inc., Bohemia, N.Y.

[21] Appl. No.: 555,116

[22] Filed: Nov. 23, 1983

[51] Int. Cl.[3] ..... B41F 13/54

[52] U.S. Cl. ..... 270/1.1; 400/605; 271/2; 271/9; 101/236

[58] Field of Search ..... 101/236–240, 101/232; 400/605, 608.2; 271/2, 9; 270/1.1

[56] References Cited

U.S. PATENT DOCUMENTS

| | | | |
|---|---|---|---|
| 4,009,957 | 3/1977 | Suzuki et al. | 271/9 |
| 4,049,256 | 9/1977 | Church et al. | 271/9 |
| 4,188,881 | 2/1980 | Bruning | 101/232 X |
| 4,191,465 | 3/1980 | Boase et al. | 271/9 |
| 4,192,607 | 3/1980 | Hage | 271/9 |
| 4,222,557 | 9/1980 | Wu | 271/9 |
| 4,253,652 | 3/1981 | Steinhilber | 271/9 |
| 4,305,655 | 12/1981 | Gamblin et al. | 271/9 |
| 4,362,100 | 12/1982 | Wu et al. | 271/2 X |
| 4,438,915 | 3/1984 | Akamatsu et al. | 271/9 |
| 4,452,543 | 6/1984 | Adkisson et al. | 271/9 |

FOREIGN PATENT DOCUMENTS

| | | | |
|---|---|---|---|
| 2441295 | 3/1975 | Fed. Rep. of Germany | 271/9 |

OTHER PUBLICATIONS

"Multiple Bin Sheet Feed Apparatus Utilizing a Single Feed Clutch", IBM Tech. Discl. Bulletin, vol. 16, No. 9, 2/74, pp. 2966–2967.

*Primary Examiner*—E. H. Eickholt

*Attorney, Agent, or Firm*—Roberts, Spiecens and Cohen

[57] ABSTRACT

Sheet and envelope feeder apparatus for a printer comprising first and second trays for respective stacks of sheets of paper and first and second drive rollers for feeding sheets of paper from the respective trays to the printer where a printing operation is effected on at least one of the faces of the sheets of paper. A third tray is provided for envelopes and a third drive roller for feeding envelopes from the third tray to the printer. The first and second drive rollers are selectively driven by a first drive motor to feed the sheets of paper. A conveyor receives the sheets of paper and the envelopes in successive groups from the printer and delivers the printed sheets of paper and envelopes to a stacking station at which the printed sheets of paper and printed envelopes are stacked one after the other successively in the order printed and wherein the printed face of each sheet of paper faces away from the next successive sheet of paper whereby the sheets of paper for each item of correspondence are collated in sequential order of printing. A second motor selectively drives the third drive roller or the conveyor.

29 Claims, 4 Drawing Figures

SHEET AND ENVELOPE FEED APPARATUS FOR A PRINTER AND ASSOCIATED METHODS

FIELD OF THE INVENTION

The invention relates to a sheet and envelope feed apparatus for a printer by which sheets and envelopes can be fed to the printer and the now printed sheets and envelopes can be stacked at a stacking station.

The invention also relates to methods by which the sheets and envelopes are fed to the printer and transported from the printer to the stacking station.

BACKGROUND

Sheet feeders for printers are well known in the art and, as an example thereof, reference is made to our earlier Application Ser. No. 321,419 filed Nov. 16, 1981, now U.S. Pat. No. 4,456,240. In this known sheet feeder, sheets of paper are fed from a tray to a printer and the printed sheets are stacked at a stacking station in the order in which the sheets are printed. In this arrangement, the sheets are fed with their printed surfaces facing the next successive sheet and in order to collate the sheets for a document or letter, it is necessary for the user to rearrange the sheets. This is a relatively tedious operation particularly where the number of printed sheets becomes substantial.

In a sheet feeder where a plurality of different types of sheets are assembled in combination with an envelope, it is especially difficult to rearrange the sheets and the envelope to prepare a given item of correspondence in readiness for mailing or assembly.

Furthermore, in the conventional sheet and envelope feeders, the sheets and envelopes are driven from each of the trays by a feed roller which, in turn, is driven from the printer platen through a combination lock gear assembly. This is slow, noisy and mechanically unreliable.

SUMMARY OF THE INVENTION

An object of the invention is to provide a sheet and envelope feeder which employs a minimum number of motors to minimize the cost of the feeder.

A further object of the invention is to provide a sheet and envelope feeder in which each motor thereof selectively carries out a plurality of drive functions. In this way, the number of motors is minimized.

A further object of the invention is to provide a sheet and envelope feeder in which the sheets and envelopes, after printing, are transported by a conveyor to a stacking station in which the printed sheets and envelopes are collated in the order printed so that they can be directly utilized without need for rearranging the sheets and envelope.

Another object of the invention is to transport the printed sheets and envelope along a path of travel such that the sheets and envelope are inverted in a stacked relation at the stacking station in order to achieve the sequential order of the sheets in each unit of correspondence constituted by the envelope and its associated sheets.

Still a further object of the invention is to provide a sheet and envelope feeder in which the trays for the sheets and envelope are arranged in a particularly compact configuration in order to minimize the size and space requirement of the feeder.

Yet another object of the invention is to interpose a conveyor in the arrangement of the trays for the sheets and envelope to minimize the space requirements by utilizing existing clearance between the trays.

In order to satisfy the above and further objects of the invention, there is contemplated a sheet feeder apparatus comprising first and second trays for respective sheets of paper and first and second drive means for feeding the sheets of paper from the respective tray. A third tray is provided for envelopes with an associated third drive means for feeding envelopes from the third tray to the printer. The first, second and third drive means are driven to feed the sheets of paper and the envelope to the printer in successive groups, each consisting of an envelope and a plurality of sheets of paper representing an item of correspondence. A conveyor means receives the sheets of paper and the envelope in successive groups from the printer and delivers the printed sheets of paper and envelopes to a stacking station at which the printed sheets of paper and printed envelopes are stacked one after the other successively in the order printed and wherein the printed face of each sheet of paper faces away from the next successive sheet of paper whereby the sheets of paper for each item of correspondence are collated in sequential order of printing.

In accordance with one embodiment of the invention, the sheets of paper are delivered to the stacking station by the conveyor means one on top of the other with their printed faces facing downwardly.

According to a particular feature of the invention, the conveyor means receives each sheet of paper and the envelopes from the printer with the printed faces thereof facing in one direction and the conveyor means inverts the sheets of paper and the envelopes at the stacking station. In this way, the printed sheets of paper which ordinarily are fed from the conveyor means, one after the other, with each successive sheet lying on top of the previous sheet i.e. in reverse order and requiring re-ordering by the user, are fed in inverted position by the conveyor means, according to the invention, so as to obviate the need for re-ordering.

In further accordance with the invention, a drive motor is employed selectively to carry out a plurality of drives. In a particular arrangement of the invention, the drive of the sheets from the respective trays by their associated drive means is carried out by a single drive motor which selectively drives such drive means. A second drive motor is operative to selectively drive the drive means of the envelope tray and the conveyor means. The second drive motor is operative first to drive the drive means of the envelope tray to feed an envelope to the printer whereafter this drive means is deactivated and the second drive motor drives the conveyor means to feed the now printed envelope to the stacking station.

In further accordance with the invention, the first and second trays for the sheets of paper are arranged one above the other in substantially parallel relation at an angle to the horizontal, the third tray for the envelopes extends substantially vertically and the stacking station is located above the third tray and includes a substantially horizontal support surface. The conveyor means is interposed between the envelope tray and the uppermost of the trays for the sheets to take advantage of available space and minimize the overall size requirement of the sheet feeder apparatus.

A further object of the invention is to provide a method of feeding sheets of paper and envelopes to a printer and stacking the printed sheets and envelopes at a stacking station at which the sheets of paper are collated in sequential order of printing in readiness for insertion into the envelope.

A further object of the invention is to minimize the number of motors employed to drive the various parts of the sheet feeder whereby each motor carries out a plurality of selective drive functions through a one way clutch arrangement.

The above and additional objects of the invention are achieved by a method comprising feeding first sheets of paper from a first tray to the printer for printing on one of the faces of the sheets of paper and feeding further sheets of paper from a second tray to the printer for printing on one of the faces of the further sheets of paper. The method further comprises feeding an envelope from a third tray to the printer for printing on the face of the envelope and conveying the printed sheets of paper and envelope in succession from the printer after the printing operation has been completed thereby and delivering the printed sheets of paper and envelope to a stacking station at which the printed sheets of paper are stacked one after another successively in the order printed in a stack with the envelope to constitute an item or correspondence and wherein the printed face of each sheet of paper faces away from the next successive sheet of paper whereby the sheets of paper for each item of correspondence are collated in sequential order of printing.

In further accordance with the invention as described above, each sheet of paper is fed from the printer with the printed face facing in one direction and the sheet of paper is delivered to the stacking station in inverted position.

In order to achieve the efficiency of drive and minimize the number of drive motors, a first drive motor selectively feeds the first and further sheets and a second drive motor selectively feeds envelopes to the printer and conveys printed sheets of paper and printed envelopes to the stacking station.

Further features, objects and advantages of the invention will become apparent to those skilled in the art upon a consideration of the detailed explanation of a specific embodiment of the invention to be given hereafter with reference to the attached drawing.

DETAILED DESCRIPTION

Figure 1:
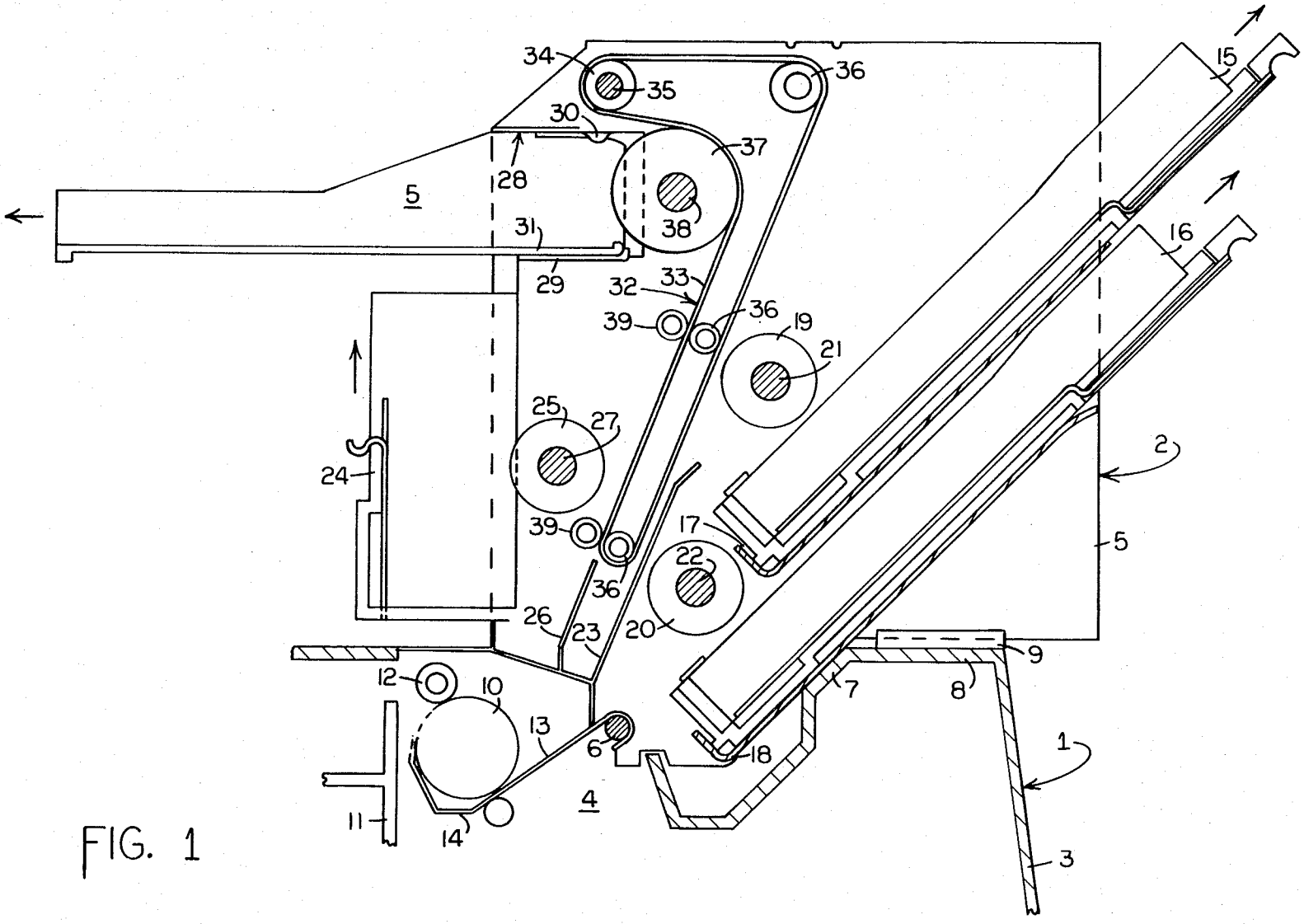
FIG. 1 is a side elevational view in section showing the sheet and envelope feeder assembled on the casing of the printer.
Figure 2:
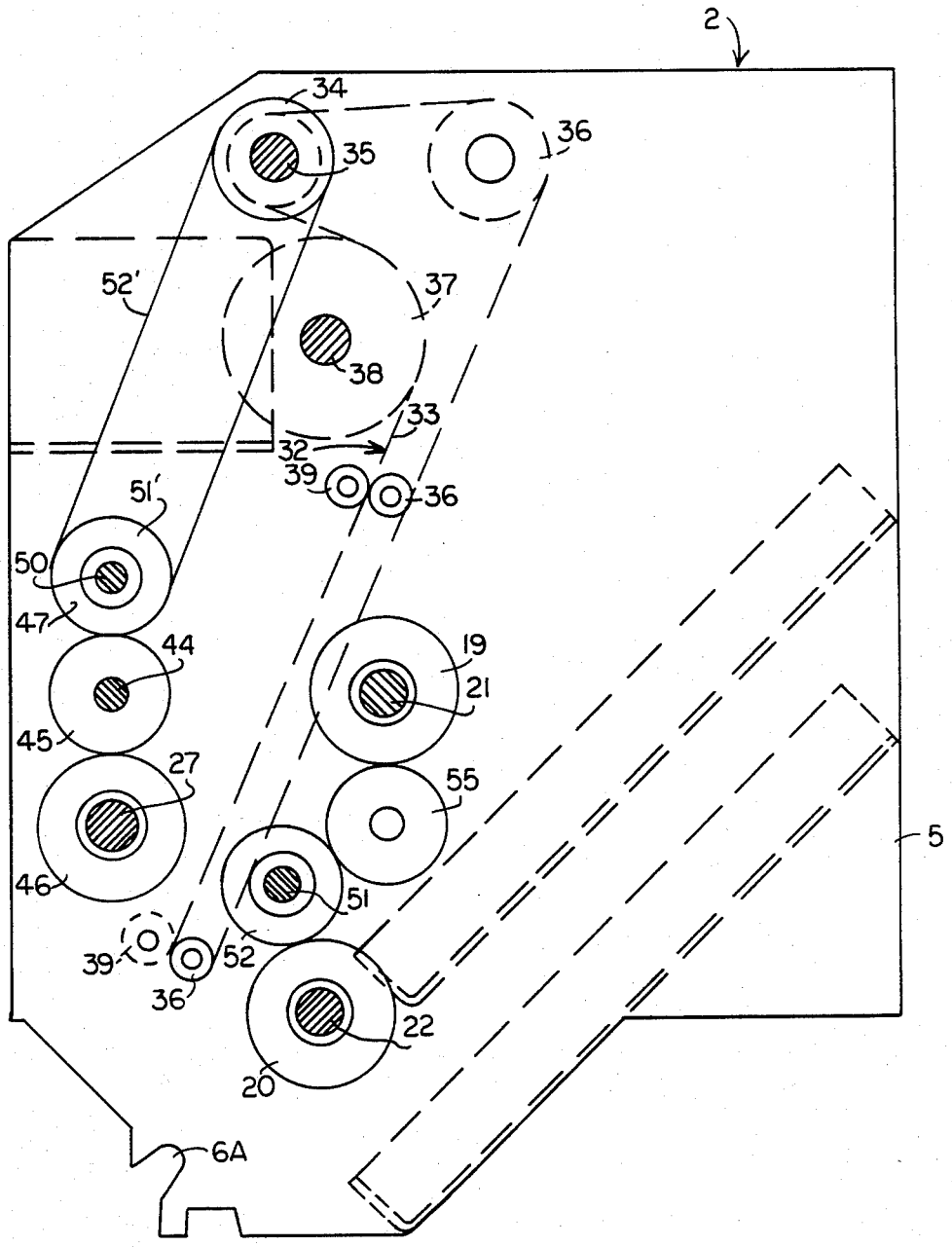
FIG. 2 is a side elevational view of the sheet and envelope feeder alone.

In FIG. 1 is seen a portion of a printer 1 which is of known construction and is illustrated to understand the co-operation of the printer with a sheet and envelope feeder 2 of the invention. The printer 1 comprises a casing 3 which has an opening 4 adapted for receiving and supporting the sheet and envelope feeder 2 in an operative position. In this regard, the feeder 2 comprises a casing 5 which rests on the casing 3 of the printer in a stable operative position as shown in FIG. 1. In particular, the casing 5 of the sheet feeder is seated on a pin 6, fixed in the printer, by engagement of the pin in a recess *6a* of the feeder and the casing 5 rests on an inclined wall portion 7 of the casing 3 of the printer and on a flat portion 8 of the casing 3 by means of a resilient pad 9 fixed to the casing 5 of the sheet feeder.

The printer contains a conventional print roller or platen 10 and a printing element 11 adapted for printing on a sheet fed to the printer from the feeder in a manner to be explained in greater detail later. An output roller 12 is in driving engagement with the print roller 10 to feed the printed sheets from the printer to the feeder as will also be explained in greater detail later. The printer also contains guides 13 and 14 for guiding sheets and envelopes to the print roller 10 and the print element 11.

The sheet and envelope feeder 2 supports removable trays 15 and 16 each adapted for containing a stack of sheets of paper. The trays 15 and 16 are supported in the feeder 2 by respective supports 17 and 18 which hold the trays in operative position in parallel inclined relation as illustrated in FIG. 1. The trays are slidable in their respective supports in order to be removed for replacement of exhausted paper. The trays are of the same construction and the details of such construction are not material to the present invention. An example of a tray which can be utilized in the present invention is described in our earlier Application Ser. No. 321,419 without the particular stacking portion disclosed therein. It is only necessary for the tray to be of the type in which the sheets of paper are capable of being stacked and where the stack is biassed upwardly so that the uppermost sheet can be fed from the stack to undergo a printing operation. Positioned above trays 15 and 16 are drive rollers 19 and 20 respectively for feeding the topmost sheet from the associated tray towards the print roller 10. The roller 19 consists of a plurality of roller elements 19*a* fixed on a common shaft 21. The roller 20 is constituted by a plurality of roller elements 20*a* fixed on a common shaft 22. Sheets of paper fed from the lower tray 16 are delivered to the guide 13 and thence to the guide 14 so as to be brought to the operative printing position where a printing operation takes place on the sheets. The sheets from the upper tray 15 are guided by a guide 23 in the feeder 2 to the guides 13 and 14 in the printer 1.

A tray 24 for envelopes is removably supported at the front face of the feeder 2 in a vertical position. The construction of the tray 24 is similar to that of the trays 15 and 16 except that the envelope tray is somewhat foreshortened. The envelope tray 24 cooperates with a drive roller 25 so that the uppermost envelope in tray 24 can be fed by the roller 25 past a further guide 26 in the feeder 2 which is positioned so that the envelope will be fed to the guides 13 and 14 in the printer in order to effect a printing operation on the envelopes. The roller 25 is constitued by a plurality of roller elements 25*a* which are secured on a shaft 27.

Situated above the envelope tray 24 is a stacking tray 28 which is slidably supported on a fixed support 29 and is capable of being moved from the operative position as shown in FIG. 1 to an access position for removal of the printed sheets and envelopes. A pivotal locking lever 30 is shown to lock the stacking tray in its operative position and to permit its removal when the printed sheets and envelopes are to be removed. The stacking tray in its operative position provides a horizontal support surface 31 at the bottom of the tray and constitutes a stacking station S.

The direction of removal of the various trays is shown by the arrows in FIG. 1 and therefrom it will be seen that in order to gain access to the envelope tray 24, the stacking tray 31 must be removed.

In conventional feeders, the printed material is fed by the output roller 12 after the printing operation has been effected onto a stacking station and the printed material is received at the stacking station in the order of printing with the printed material facing upwardly. This requires re-organization in order to collate the printed sheets in sequential numerical order, as for example, for assembling a letter. As will be seen hereafter, the present invention achieves stacking of the printed sheets of paper such that the printed face of each sheet of paper faces away from the next successive sheet of paper whereby the sheets of paper are collated in sequential order of printing. This requires no re-organization by the user and the printed sheets can be directly taken from the stacking tray ready for use.

Figure 3:
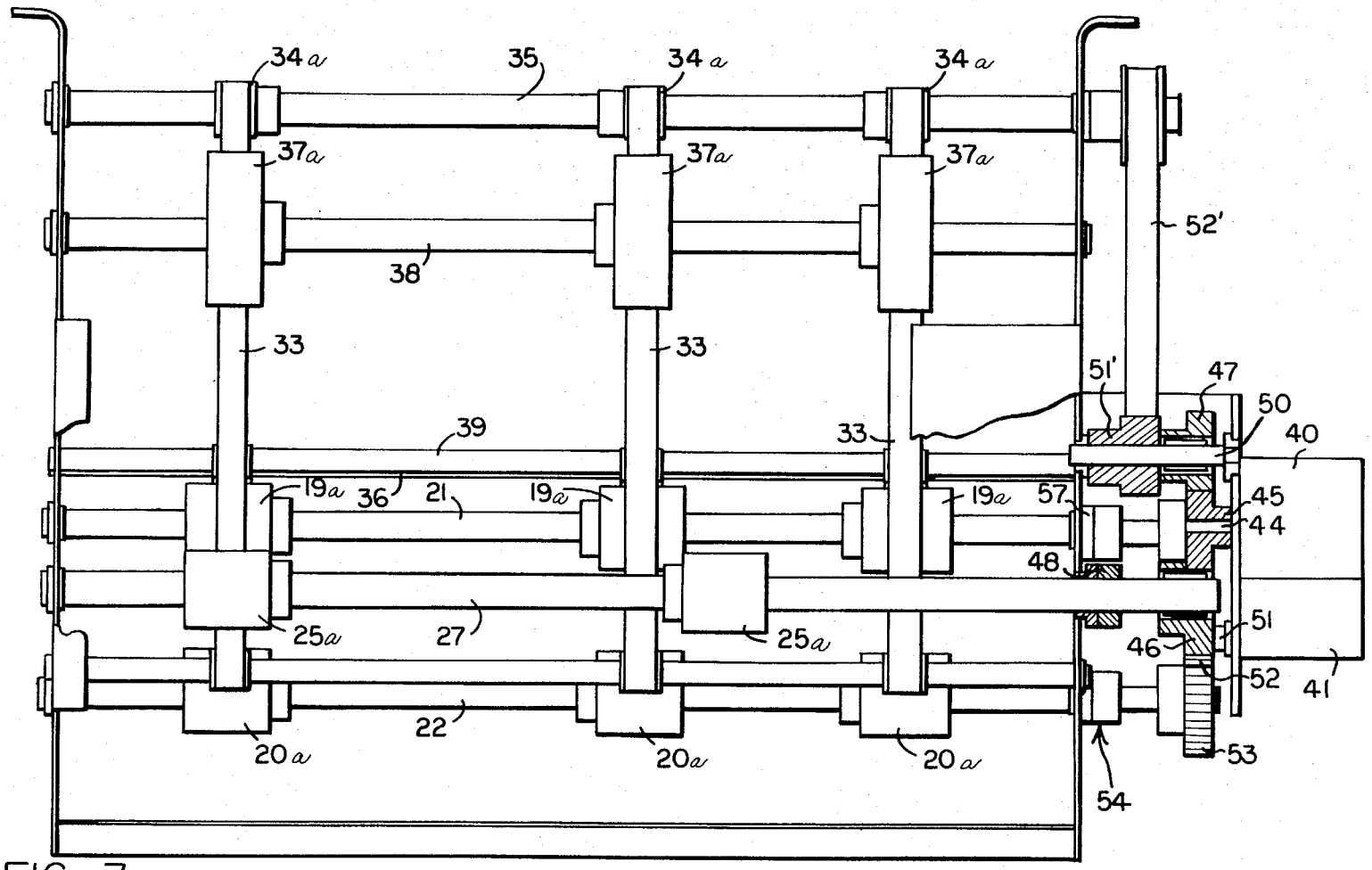
FIG. 3 is an end elevational view of the sheet and envelope feeder with the trays removed and wherein a partial sectioning has been taken for one of the drives.

In order to achieve this, the invention provides for a conveyor mechanism 32 which receives the printed material from the output roller 12 and the print roller 10 of the printer via guide 26 and which transports the printed material to the stacking tray 28 and deposits the same therein in inverted relation to the position of the material when it is fed from the rollers 10 and 12. The conveyor mechanism comprises a plurality of parallel endless bands 33 spaced laterally from one another adapted for conveying the printed material from the printer to the stacking station. The bands 33 travel along a convoluted path under the action of a drive roller 34 consisting of roller elements 34*a* each operatively engaging a respective band 33. The roller elements 34*a* are fixed to a shaft 35 as seen in FIG. 3. Idler and guide rollers 36 are mounted in the casing 5 of the feeder 2 to establish the path of travel of the endless bands 33 of the conveyor mechanism 32. A relatively large diameter reversing roller 37 is positioned near the drive roller 34 and the reversing roller is constituted by roller elements 37*a* fixed to shaft 38. The bands 33 travel around respective roller elements 37*a* in undergoing a change in path. A pair of further drive rollers 39 are disposed along the path of travel of the conveyor in opposition to adjoining idler rollers 36 to transport the printed material along the conveyor to roller 37 and thence to the stacking station.

The path of travel for the printed material coming from the rollers 10 and 12 of the printer is as follows. The printed material is guided by guide 26 to travel between drive roller 39 and driven bands 33 so as to be advanced with the conveyor for entry between the reversing roller 37 and the conveyor belt and be transported therearound until it exits therefrom and is deposited onto the stacking surface 31 of the stacking tray 28 at the stacking station S. As seen, the printed material undergoes an inversion from the position it was in at the point of discharge from rollers 10 and 12 as compared to the condition it is deposited onto support surface 31.

Ordinarily, the tray 15 contains letterhead paper whereas the tray 16 contains plain paper. The first sheet of an item of correspondence is the letterhead paper and this is followed by successive sheets of plain paper. Thus, the letterhead paper is fed first from tray 15 through the printer and is then deposited face down in the stacking tray 28. Thereafter, the sheets of plain paper, to form the item of correspondence, are fed from tray 16 to the tray 28 and are deposited in succession on top of the sheet of paper originating from the tray 15. The envelope for this item of correspondence is then fed from the tray 24 and ends up on top of the already stacked sheets to complete the item of correspondence. The user can now remove the printed sheets and envelope and the sheets will be arranged in the collated sequential order of printing ready for insertion into the printed envelope. In operation, a succession of items of correspondence consisting of the printed sheets and the respective envelopes will be stacked one on the other in the stacking tray 28 until this is filled and the stacking tray is removed to remove the stacked items of correspondence.

A feature of the invention is the arrangement of the motors employed to drive the sheets of material and envelopes of the sheet feeder of the invention. The feeder of the invention employs two motors to achieve four drive motions in a particularly unique and efficient fashion. It is to be recalled that the motors of the feeder are high precision stepping motors which must be within plus or minus 2° of tolerance in order to produce correct feed of the sheets and envelopes so that printing will be effected at the proper locations whereon.

Figure 4:
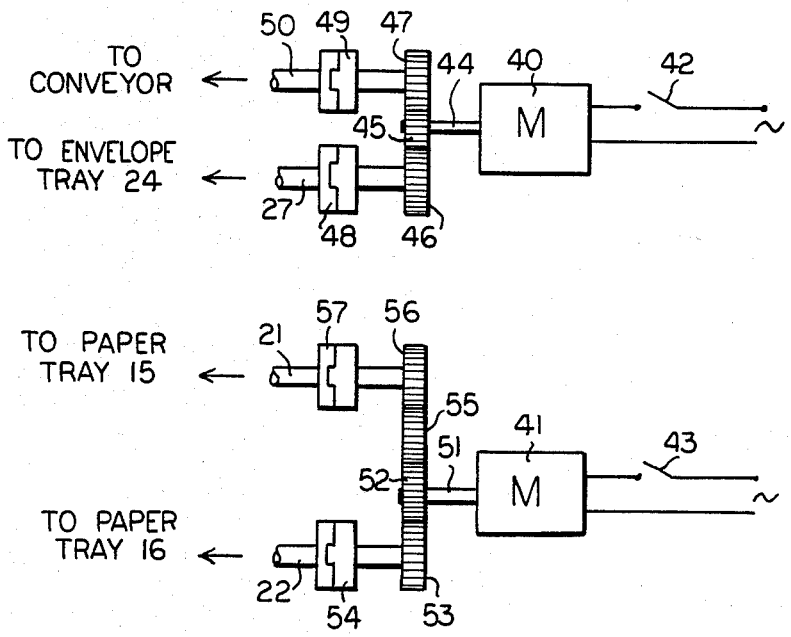
FIG. 4 is a diagrammatic illustration of the drive means for the mechanisms of the sheet and envelope feeder.

Referring to FIG. 4, therein is shown a diagrammatic illustration of the drive for the elements of the feeder 2 of the invention. As seen in FIG. 4, two stepping motors 40 and 41 are respectively connected to AC power via respective switches 42 and 43. Motor 40 drives an output shaft 44 to which is fixed a gear 45. The gear 45 is in mesh with gears 46 and 47 respectively coupled to clutches 48 and 49. The output of clutch 48 connected to shaft 27 which carries the drive roller 25 for feeding envelopes from envelope tray 24. The output of clutch 49 is connected to shaft 50 which carries a roller 51 coupled to the drive roller 34 of the belt mechanism via a drive belt 52.

In operation, when switch 42 is closed, motor 40 is energized to drive gears 46 and 47. The clutches 48 and 49 are operated selectively to drive the feed roller of the envelope tray to feed envelopes therefrom or to drive the conveyor mechanism 42 for feeding envelopes or sheets of material originating in trays 15 and 16. The operation of the switch 42 and the clutches 48 and 49 is controlled by a micro-processor inside the printer such that for feed of envelopes, the roller 25 is driven to feed the uppermost envelope in tray 24 to the rollers 10 and 12 of the printer whereupon the printed envelope now exits from the printer under the drive of the rollers 10 and 12. When the printed envelope has entered the nip between rollers 10 and 12 and is in the course of being displaced thereby towards the guide 26, the clutch 48 is deactivated and the clutch 49 is activated whereby the motor now drives the conveyor. Thereby, as the envelope advances further under the drive of rollers 10 and 12, the envelope enters between the nip of idler roller 39 and the conveyor belt to be advanced by the conveyor belt up to the stacking tray 28. After the envelope has reached the stacking tray, the clutch 49 is deactivated in readiness for the next sequence in the printing operation.

The motor 41 which selectively feeds sheets of paper from trays 15 and 16 has an output shaft 51 which drives a gear 52. The gear 52 is in mesh with a gear 53 which is connected via a clutch 54 to the shaft 22 which carries the drive roller 20 for the sheets in the lower tray 16. The gear 52 is also in mesh with a reversing gear 55 which, in turn, is in mesh with a gear 56 coupled to clutch 57. The output of clutch 57 is coupled to shaft 21 which drives roller 19 for feeding sheets of paper from the upper tray 15. The reversing roller 55 serves the function of reversing the direction of drive of gear 56 so that it is in the same direction of rotation as gear 53.

In operation, when sheets of paper are to be printed, the switch 43 is closed and clutch 57 is activated. Thereby, roller 19 is driven to advance the uppermost sheet of letterhead paper from tray 15 to the printer where the letterhead sheet is printed and fed towards the conveyor. Switch 42 is closed and clutch 49 is activated so that the conveyor drivingly receives the letterhead sheet of paper and advances the same to the stacking tray 28. The clutch 57 is now deactivated and the clutch 54 is activated so that the shaft 22 is driven to drive roller 20 thereon to feed a sheet of plain paper from the tray 16 to the printer. The switch 42 is closed and the clutch 49 is activated so that the conveyor will transport the printed sheet of palin paper to the stacking tray 28. The drive roller 20 will be successively driven from motor 41 in accordance with the number of sheets of plain paper to be printed for the given item of correspondence. The sheets of plain paper, after being printed, are successively fed by the conveyor to the stacking tray 28. Thereafter, the envelope associated with the particular item of correspondence is fed in the manner as explained previously to the printer and therefrom to the conveyor and the stacking tray.

As has been shown above, two motors are used to produce four forward drive motions, each motor being selectively capable of carrying out the drive of a pair of output shafts. In this way, the number of motors is minimized which ends up in a realization of economy in the cost of the feeder.

The use of the motor 40 to selectively drive the drive roller 25 of the envelope tray and the drive roller 34 of the conveyor is based on the disposition of the envelope tray as shown in FIG. 4 in relation to the rollers 10 and 12 of the printer and the entrance of conveyor 32. Namely, in order to achieve sequential feed of an envelope to the printer and the conveyor, the envelope is initially fed by the drive roller 25 to the printer under the drive of motor 40 whereat the envelope is printed. The drive roller 25 is deactivated by deactivating the clutch 48 prior to the printing operation. After the envelope has been printed, it is advanced by rollers 10 and 12 of the printer to the conveyor 32 which is now driven by motor 40 via clutch 49 which is now activated. The path of feed of the envelope from the envelope tray to and through the printer to the entry of the conveyor is so arranged that the envelope can be fed by drive roller 25 under the drive of the motor 40 to the printer whereafter the motor 40 drives the conveyor to feed the now printed envelope to the stacking station. The operation takes place substantially continuously except for the period of printing at which time the clutches 48 and 49 are switched over to switch the drive from roller 25 to roller 34.

Although the invention has been described in relation to a specific embodiment thereof, it will become apparent to those skilled in the art the numerous modifications and variations can be made thereof within the scope and spirit of the invention as defined by the attached claims.

What is claimed is:

1. Sheet feeder apparatus for a printer comprising a first tray for first sheets of paper, a first drive means for feeding sheets of paper from the first tray to the printer where a printing operation is effected on at least one of the faces of the sheets of paper, a second tray for further sheets of paper, a second drive means for feeding the sheets of paper from the second tray to the printer where a printing operation is effected on at least one of the faces of the further sheets of paper, a third tray for envelopes, a third drive means for feeding envelopes from the third tray to the printer where a printing operation is effected on the faces of the envelopes, the first, second and third drive means being driven to feed the sheets of paper and envelopes to the printer in successive groups each consisting of an envelope and sheets of paper representing an item of correspondence, and conveyor means for receiving the sheets of paper and the envelopes in successive groups from the printer and delivering the printed sheets of paper and envelopes to a stacking station at which the printed sheets of paper and printed envelopes are stacked one after the other successively in the order printed and wherein the printed face of each sheet of paper faces away from the next successive sheet of paper whereby the sheets of paper for each item of correspondence are collated in sequential order of printing.

2. Sheet feeder apparatus as claimed in claim 1 wherein said conveyor means delivers the sheets of paper to the stacking station one on top of the other with their printed faces facing downwardly.

3. Sheet feeder apparatus as claimed in claim 1 wherein the conveyor means receives each sheet of paper from the printer with the printed face facing in one direction and inverts the sheet of paper at the stacking station.

4. Sheet feeder apparatus as claimed in claim 3 wherein said conveyor means comprises an endless conveyor belt.

5. Sheet feeder apparatus as claimed in claim 1 comprising a drive motor for selectively driving said first drive means and said second drive means.

6. Sheet feeder apparatus as claimed in claim 1 comprising a drive motor for selectively driving said third drive means and said conveyor means.

7. Sheet feeder apparatus as claimed in claim 6 wherein for feeding envelopes, said drive motor is operative first to drive said third drive means to feed an envelope to the printer whereafter said third drive means is deactivated and said drive motor drives said conveyor means to feed the now printed envelope to the stacking station.

8. Sheet feeder apparatus as claimed in claim 1 wherein said third drive means is operative to feed the envelopes to the printer after completion of the printing operation on the sheets of paper from the first and second trays such that in each group the printed sheets are stacked in the order printed with the envelope last.

9. Sheet feeder apparatus as claimed in claim 8 wherein said conveyor means delivers the sheets of paper to the stacking station one on top of the other with their printed faces facing downwardly and with the envelope on top of the stacked sheets.

10. Sheet feeder apparatus as claimed in claim 1 wherein said first and second trays are arranged one above the other in substantially parallel relation at an angle to the horizontal, said third tray extends substantially vertically and said stacking station is located above said third tray and includes a substantially horizontal support surface.

11. Sheet feeder apparatus as claimed in claim 1 wherein said conveyor means is interposed between two of said trays and has an outlet facing the stacking station.

12. A printer comprising a print roller, a print element opposite the print roller, an output roller opposite the print roller and located past the print roller and located past the print element and sheet feeder means for feeding sheets of paper and envelopes to the print roller for printing by the print element on one of the faces of each of the sheets of paper and envelopes and for delivering the thus printed sheets and envelopes to a stacking station, at which the now printed sheets of paper are stacked one after the other successively in the order printed in successive groups each consisting of an envelope and sheets of paper representing an item of correspondence and wherein the printed face of each sheet of paper faces away from the next successive sheet of paper whereby the sheets of paper for each item of correspondence are collated in sequential order of printing, said sheet feeder means comprising a conveyor means for receiving the sheets of paper and envelopes in succession from the output and print rollers, after the printing of said sheets of paper and envelopes, to deliver the same to said stacking station, a first tray for first sheets of paper, a first drive means for feeding the sheets of paper from the first tray for undergoing a printing operation thereon, a second tray for further sheets of paper, a second drive means for feeding the sheets of paper from the second tray for undergoing a printing operation thereon, a third tray for envelopes, a third drive means for feeding envelopes from the third tray for undergoing a printing operation thereon, a first drive motor for selectively driving said first drive means and said second drive means, and a second drive motor for selectively driving said third drive means and said conveyor means.

13. A printer as claimed in claim 12 wherein said conveyor means delivers the sheets of paper to the stacking station one on top of the other with their printed faces facing downwardly.

14. A printer as claimed in claim 12 wherein the conveyor means receives the printed sheets of paper and envelopes with the printed faces thereof facing in one direction and feeds the sheets of paper and envelopes to the stacking station in inverted position.

15. A printer as claimed in claim 12 wherein said conveyor means is interposed between two of said trays and has an outlet facing the stacking station.

16. A printer as claimed in claim 12 wherein for feeding envelopes, said second drive motor is operative first to drive said third drive means to feed an envelope for a printing operation thereon whereafter said third drive means is deactivated and said second drive motor drives said conveyor means to feed the now printed envelope to the stacking station.

17. A printer as claimed in claim 12 wherein said third drive means is operative to feed an envelope to the print element for a printing operation on the envelope after completion of the printing operation on the associated sheets of paper of the respective item from the first and second trays such that in the stack the printed sheets of each item are stacked in the order printed with the envelope last.

18. A printer as claimed in claim 15 wherein said conveyor means delivers the sheets of paper to the stacking station one on top of the other with their printed faces facing downwardly and with the associated envelope on top of the stacked sheets.

19. A printer as claimed in claim 12 wherein said first and second trays are arranged one above the other in substantially parallel relation at an angle to the horizontal, said third tray extends substantially vertically and said stacking station is located above said third tray and includes a substantially horizontal support surface.

20. A printer as claimed in claim 19 wherein said conveyor means extends between said third tray and the uppermost one of the first and second trays at an angle thereto.

21. Sheet feeder apparatus for a printer comprising a first tray for sheets of paper, a first drive means for feeding sheets of paper from the first tray to a printer where a printing operation is effected on at least one of the faces of the sheets of paper, a second tray for envelopes, a second drive means for feeding envelopes from the second tray to the printer where a printing operation is effected on the faces of the envelopes, the first and second drive means being driven to feed the sheets of paper and envelopes to the printer successively in the order to be printed and conveyor means extending between said trays for receiving the sheets of paper and the envelopes from the printer and for delivering the printed sheets of paper and envelopes to a stacking station at which the printed sheets of paper and printed envelopes are stacked one after the other.

22. Sheet feeder apparatus as claimed in claim 21 comprising a first drive motor for the first drive means, a second drive motor, and means for selectively coupling the second drive motor with said second drive means and with said conveyor means such that the printed sheets of paper can be fed by the conveyor means under the drive of the second motor whereas the envelopes can be fed from the second tray to the printer under the drive of the second motor and thereafter conveyed in continuation by the conveyor means also under the drive of said second motor.

23. Sheet feeder apparatus for a printer comprising a first tray for first articles to be printed, a first drive means for feeding said articles from the first tray to a printer where a printing operation is effected on said articles, a second tray for further articles to be printed, a second drive means for feeding said further articles from the second tray to the printer where a printing operation is effected on said articles, the first and second drive means being driven to feed said articles to the printer successively in the order to be printed, transport means including a conveyor extending between said trays for receiving the articles from the printer and for delivering the now printed articles to a stacking station at which the printed articles are stacked one after the other successively in the order printed, a first drive motor for the first drive means, a second drive motor, and means for selectively coupling the second drive motor with said second drive means and with said conveyor such that the articles from the first tray can be conveyed, after printing by the printer, by said conveyor under the drive of said second drive motor whereas the articles in the second tray can be driven therefrom to the printer under the drive of the second drive motor and thereafter conveyed in continuation by the conveyor also under the drive of the second drive motor.

24. A method of feeding sheets of paper and envelopes to a printer and stacking the printed sheets and envelopes, said method comprising feeding first sheets of paper from a first tray to a printer for printing on one of the faces of the sheets of paper, feeding further sheets of paper from a second tray to the printer for printing on one of the faces of the further sheets of paper, feeding an envelope from a third tray to the printer for printing on the face of the envelope, conveying the printed sheets of paper and envelope in succession from the printer after the printing operation has been completed thereby along a path between the envelope feed path and the paper sheet paths and delivering the printed sheets of paper and envelope to a stacking station at which the printed sheets of paper are stacked one after another successively in the order printed in a stack with the envelope to constitute an item of correspondence and wherein the printed face of each sheet of paper faces away from the next successive sheet of paper whereby the sheets of paper for each item of correspondence are collated in sequential order of printing.

25. A method as claimed in claim 24 wherein the printed sheets of paper are delivered to the stacking station one on top of the other with their printed faces facing downwardly.

26. A method as claimed in claim 24 wherein each sheet of paper is fed from the printer with the printed face facing in one direction and the sheet of paper is delivered to the stacking station in inverted relation.

27. A method as claimed in claim 24 wherein a first drive motor selectively feeds the first sheets and the further sheets and a second drive motor selectively feed envelopes to the printer and conveys printed sheets of paper and envelopes to the stacking station.

28. A method as claimed in claim 27 wherein for feeding envelopes, the second drive motor is operative first to feed an envelope to the printer whereafter the now printed envelope is fed to the stacking station.

29. A method as claimed in claim 24 wherein the envelopes are fed to the printer after completion of the printing operation on the sheets of paper such that in the stack the printed sheets are stacked in the order printed with the envelope last.

* * * * *